US005825406A

United States Patent [19]

Orlicki et al.

[11] Patent Number: 5,825,406

[45] Date of Patent: Oct. 20, 1998

[54] INERTIA AND WINDAGE REDUCTION FOR IMAGING APPARATUS WITH ROTATION WRITE HEAD

[75] Inventors: David M. Orlicki, Rochester; Karen L. Herczeg, Webster, both of N.Y.

[73] Assignee: Eastman Kodak Company, Rochester, N.Y.

[21] Appl. No.: 638,910

[22] Filed: Apr. 24, 1996

[51] Int. Cl.[6] ..... B41J 2/47

[52] U.S. Cl. ..... 347/264

[58] Field of Search ..... 347/257, 260, 347/242, 258, 135, 262, 38, 47, 43, 68, 88, 264

[56] References Cited

U.S. PATENT DOCUMENTS 4,479,133 10/1984 Shiozawa et al. ..... 346/108
4,714,936 12/1987 Helinski et al. ..... 347/38
5,659,349 8/1997 Albano et al. .

FOREIGN PATENT DOCUMENTS 0 217 001 4/1987 European Pat. Off. .
0 679 520 11/1995 European Pat. Off. .

*Primary Examiner*—Mark J. Reinhart
*Attorney, Agent, or Firm*—Walter S. Stevens

[57] ABSTRACT

An imaging apparatus has a support shoe with an at-least-partially cylindrical inner surface for receiving a recording media. A rotor is simultaneously rotatable about, and linearly translated along, a fixed axis; and a write head assembly is carried by the rotor to write on recording media received on the inner surface of the support shoe. A pair of disks, having arcuate outer peripheries, are supported within the support shoe for movement with the rotor along the fixed axis on opposed axial sides of the rotor. One of the disks leads the translation of the rotor along the fixed axis as the rotor moves in either axial direction during a write operation. The disks are rotationally fixed relative to the support shoe and have circular outer peripheries.

4 Claims, 5 Drawing Sheets

INERTIA AND WINDAGE REDUCTION FOR IMAGING APPARATUS WITH ROTATION WRITE HEAD

CROSS-REFERENCE TO RELATED APPLICATIONS

Reference is made to commonly assigned, co-pending U.S. patent applications Ser. No. 08/123,838 entitled LEAD-SCREW COUPLER filed in the names of Jadrich et al. on Sep. 20, 1993; Ser. No. 08/123,839 entitled METHOD AND APPARATUS FOR EXPOSING PHOTOSENSITIVE MEDIA WITH MULTIPLE LIGHT SOURCES filed in the names of Smith et al. on Sep. 20, 1993; and Ser. No. 08/371,241, entitled DIGITAL PRINTER WITH SUPPORT SHOE AND TRANSLATABLE MEDIA GUIDE MEMBER THEREIN filed in the name of M. Bridges on Jan. 11, 1995.

BACKGROUND OF THE INVENTION

1. Technical Field

The present invention relates generally to imaging apparatus such as printers and copiers that form media into a cylindrical shape for exposure by a rotating write head, and more particularly to a system for reducing inertia and windage in the imaging apparatus.

2. Background Art

Digital imaging in printers and copiers is accomplished by modulating the intensity of a light beam that forms a writing spot on photosensitive media as the beam moves relative to the photosensitive media. One type of imaging apparatus uses a modulated array of light emitting diodes (LED's) positioned on a write head assembly resident on a rotor which is simultaneously rotated about a fixed axis and linearly translated past stationary photosensitive recording media mounted on the inner surface of a cylindrical "support shoe" to form a plurality of writing spots moving across the photosensitive material in a fast scan direction and in a slow scan direction, such as disclosed in commonly assigned, co-pending U.S. patent application Ser. No. 08/371,241, entitled DIGITAL PRINTER WITH SUPPORT SHOE AND TRANSLATABLE MEDIA GUIDE MEMBER THEREIN filed in the name of M. Bridges on Jan. 11, 1995. The disclosure of the Bridges patent application is hereby specifically incorporated herein by reference.

DISCLOSURE OF THE INVENTION

It is an object of the present invention to provide for the reduction of inertia and mass distribution far from the axis of rotation of rotating write heads without increasing windage.

It is another object of the present invention to attain low windage of a rotating write head by the addition of wind-blocking structure without increasing the inertia and risk of dynamic imbalance.

According to the present invention, an imaging apparatus has a support shoe with an at-least-partially cylindrical inner surface for receiving a recording media. A rotor is simultaneously rotatable about, and linearly translated along, a fixed axis; and a write head assembly is carried by the rotor to write on recording media received on the inner surface of the support shoe. The imaging apparatus further includes a pair of disks having arcuate outer peripheries, wherein the disks are supported within the support shoe for movement with the rotor along the fixed axis on opposed axial sides of the rotor.

According to a preferred embodiment of the present invention, one of the disks leads the translation of the rotor along the fixed axis as the rotor moves in either axial direction during a write operation. The disks are rotationally fixed relative to the support shoe and have circular outer peripheries.

The invention, and its objects and advantages, will become more apparent in the below description of the preferred embodiments.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

The present description will be directed, in particular,2 to elements forming part of, or cooperating more directly with, apparatus in accordance with the present invention. It is to be understood that elements not specifically shown or described may take various forms well known to those skilled in the art.

Figure 1:
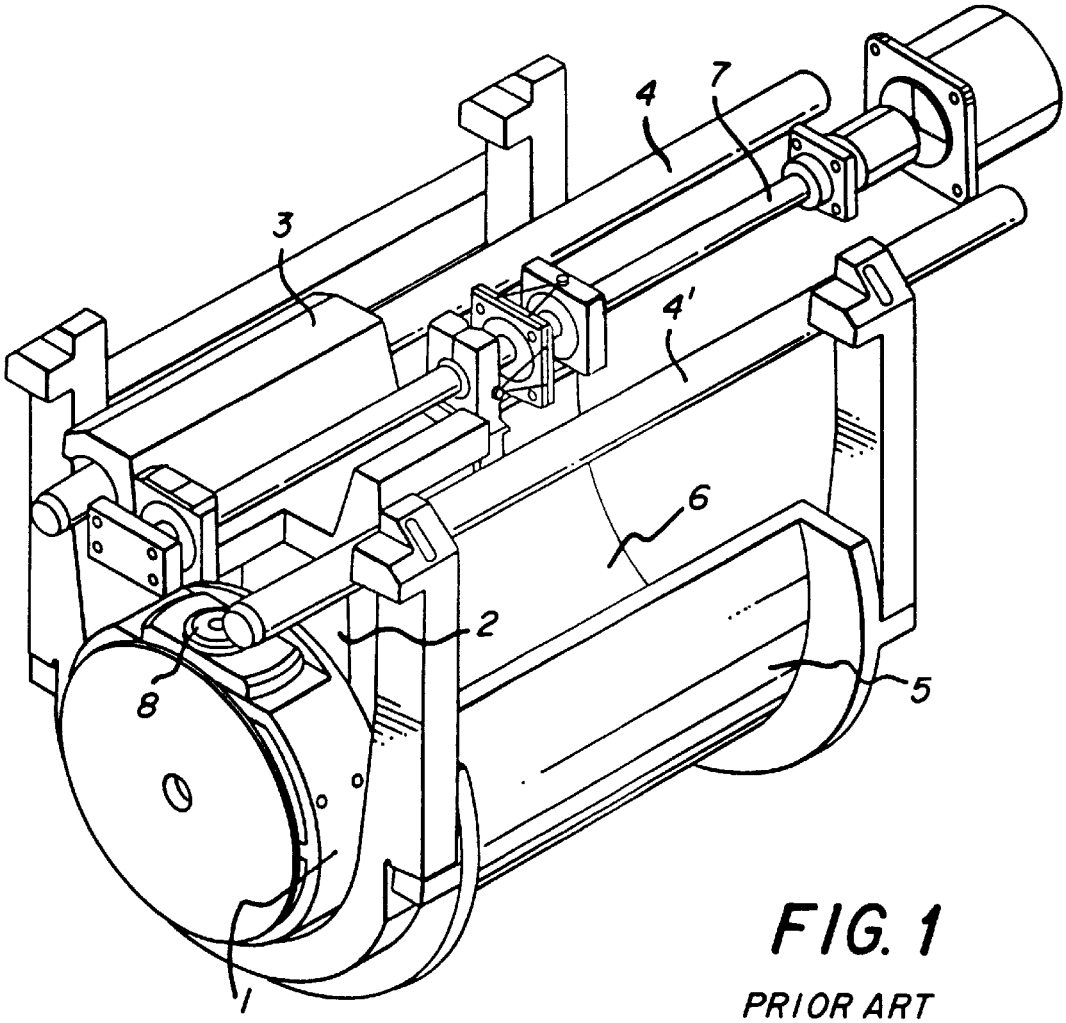
FIG. 1 PRIOR ART
FIG. 1 a perspective view of a rotary printing system according to the prior art.

A rotary printing system according to the prior art and employing a multi-position lens assembly is illustrated in FIG. 1. A rotor 1 coupled to a drive motor, not shown, is supported by a rotor support member 2 which hangs from a carriage assembly 3 which is movable along a pair of guide rods 4 and 4'. The rotor is arranged to spin and move axially within a cylindrical support shoe 5 which is provided with a sheet of photosensitive material on the inner surface 6 thereof. Rotor 1 is attached to a linear translation assembly comprising rotor support member 2, carriage assembly 3, and a lead screw 7 driven by a stepper motor. See commonly assigned, co-pending U.S. patent application Ser. No. 08/123,838 entitled LEADSCREW COUPLER, filed in the names of Jadrich et al. on Sep. 20, 1993. The disclosure of the Jadrich et al. patent application is hereby specifically incorporated herein by reference. The rotor is simultaneously rotated by the drive motor in a fast scan direction and is translated past the cylindrical support shoe in the slow scan direction (axially) by the stepper motor and lead screw 7, thereby achieving a raster scan pattern on the photosensitive media held within the support shoe.

An LED printhead assembly 8 is mounted in rotor 1 and comprises a plurality of mono-color light sources such as an array of LED's and a projection lens assembly. The projection lens assembly is arranged to simultaneously image (focus) all of the LED's in the array onto a surface located in close proximity above the outer surface of the rotor, and more particularly, onto the inner surface of the photosensitive material held by support shoe 5. A single projection lens array thereby images the plurality of LED's onto the photosensitive material as a plurality of individual images which constitute the writing beams that expose the image pixels. Additional details of the LED array and the generation of pixel control signals can be found in U.S. patent application Ser. No. 08/123,839 entitled METHOD AND APPARATUS FOR EXPOSING PHOTOSENSITIVE MEDIA WITH MULTIPLE LIGHT SOURCES filed in the names of Smith et al. on Sep. 20, 1993. The disclosure of the Smith et al. patent application is hereby specifically incorporated herein by reference.

Figure 2:
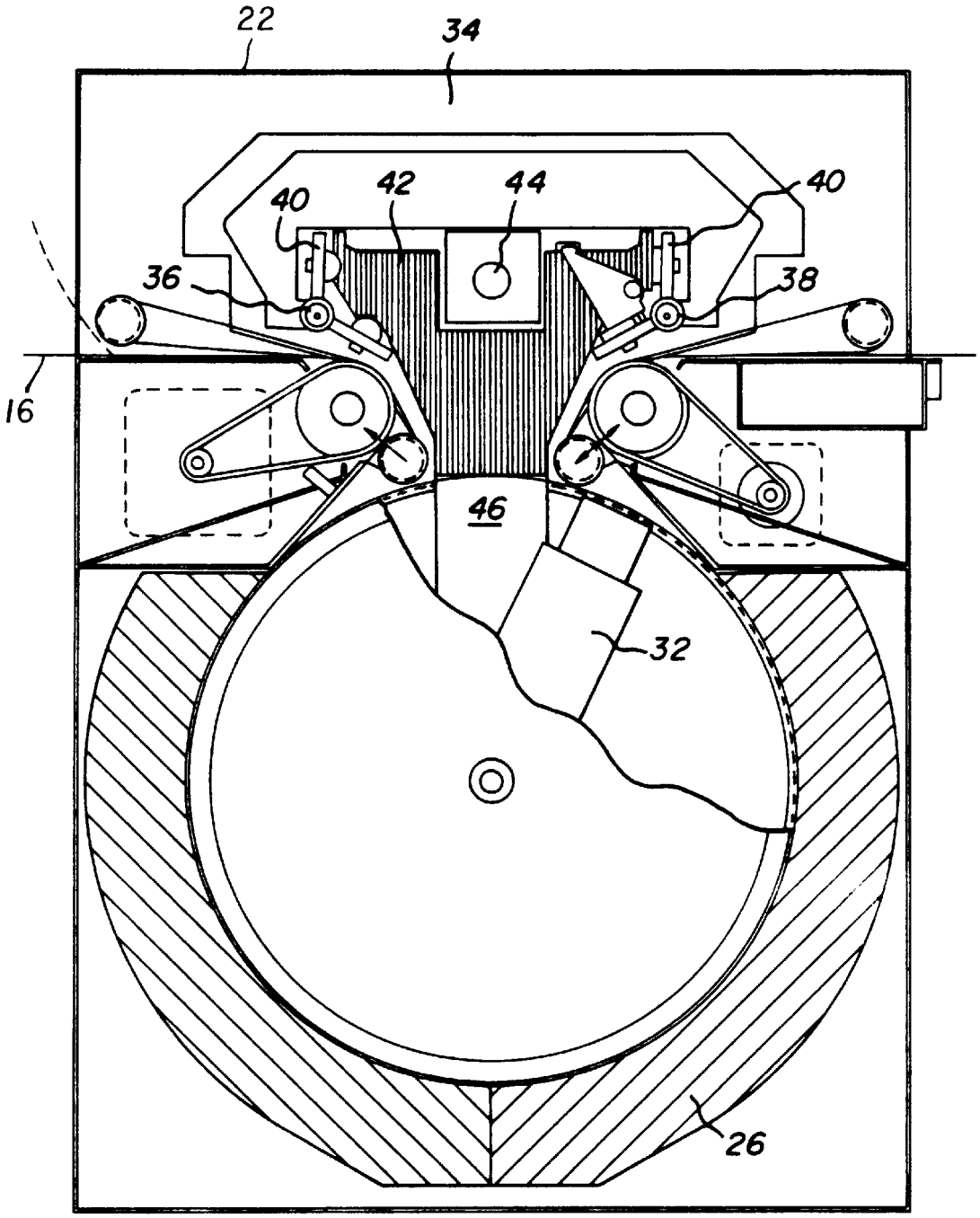
FIG. 2 is a schematic illustration of a printer incorporating a preferred embodiment of the present invention.

FIG. 2 is a schematic illustration of a printer incorporating a preferred embodiment of the present invention. A web of photographic light sensitive media 16 is fed to a write station 22 which is disclosed in detail in the above-mentioned U.S. patent application entitled DIGITAL PRINTER WITH SUPPORT SHOE AND TRANSLATABLE MEDIA GUIDE MEMBER THEREIN. The write station includes a cylindrical support shoe 26 (corresponding to support shoe 5 in the prior art device of FIG. 1). The arcuate inner surface of cylindrical support shoe 26 is precisely bored so that an LED illumination means, not shown, mounted on a rotor 32 focuses on the emulsion side of media 16. A translator base assembly 34 is attached to framework to support guide rods 36 and 38.

Figure 3:
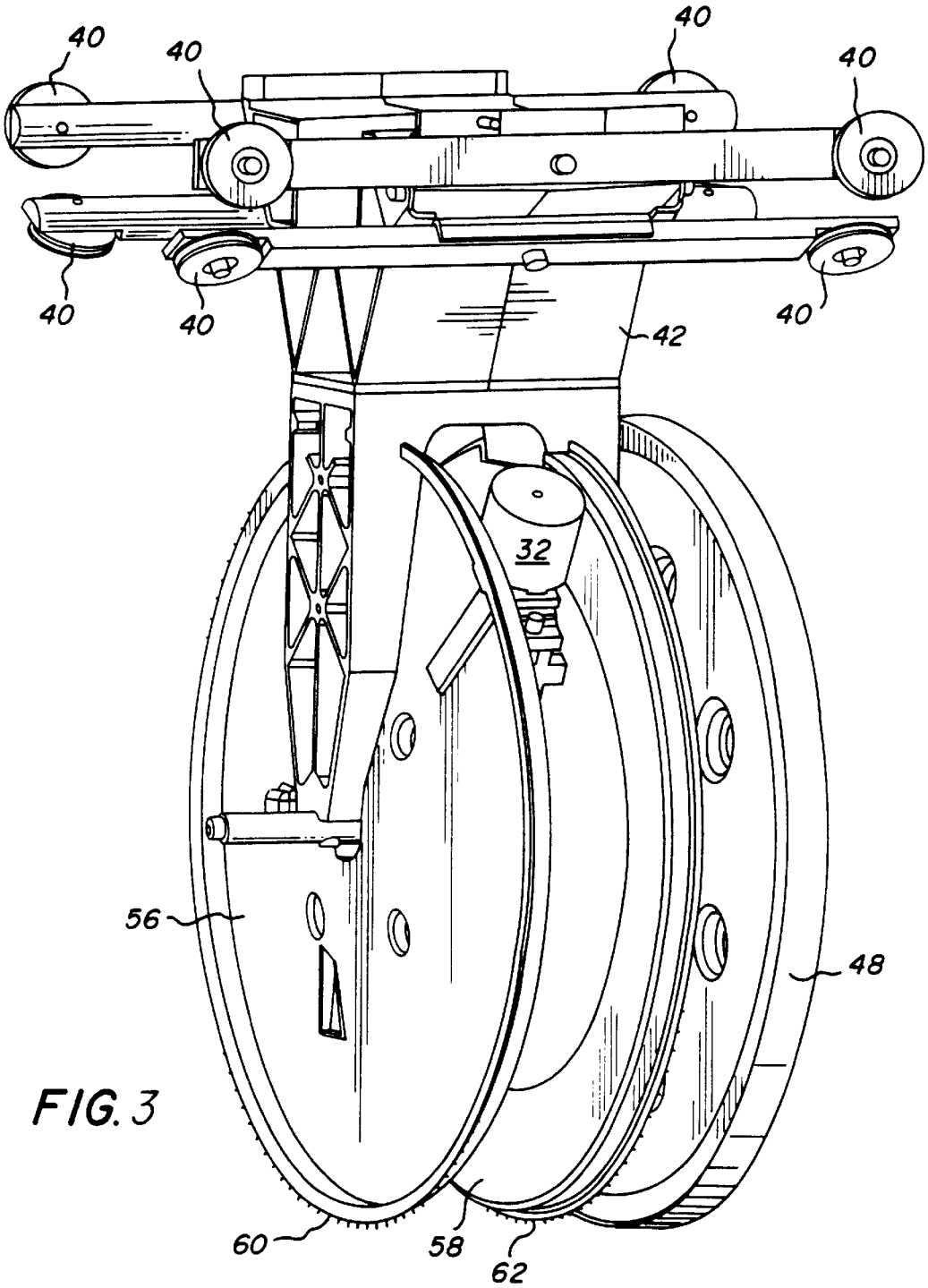
FIG. 3 is an enlarged perspective view of a portion of the printer of FIG. 2.

As may be best seen in FIG. 3, along with other features now to be mentioned, a plurality of wheels 40 are rotatably attached to a carriage 42 which translates along guide rods 36 and 38 by means of a lead screw 44 turned by a lead screw motor, not shown. See afore-mentioned U.S. patent application Ser. No. 08/123,838 entitled LEADSCREW COUPLER. A rotor support member 46 (corresponding to rotor support member 2 in the prior art device of FIG. 1) is rigidly attached to carriage 42, and carries rotor 32. Also attached to rotor support member 46 is a media guide disc 48 arranged such that a space gap is created between the outer diameter of the media guide disc and the arcuate inner surface of support shoe 26.

Figure 4:
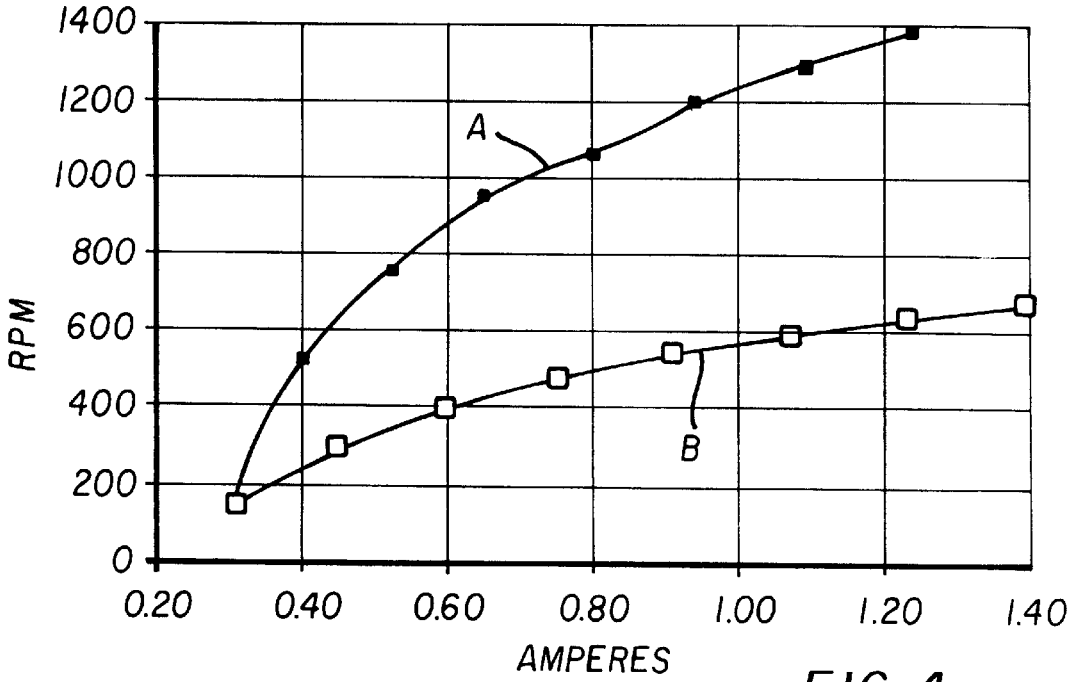
FIG. 4 is a graph of rotor speed versus the motor current required to drive a prior art rotor.

During experiments which were performed on rotor geometries described herein to optimize the tradeoffs between rotor inertia and windage, a right circular cylinder configuration such as disclosed in U.S. Pat. No. 4,479,133, issued to Shiozawa et al. on Oct. 23, 1984, was considered. The smooth, continuous end surfaces of this design appeared to promise low windage, but it was found that the distribution of rim and side wall mass contributed to inertia growth approximately as the cube of the rotor diameter. FIG. 4 is a graph of rotor speed versus the motor current required to drive the rotor. Curve "A" represents a rotor with smooth, continuous end surfaces. Thus, while the Shiozawa et al. configuration may be considered to be optimal strictly from a windage point of view, the extremely high inertia and mass distribution far from the axis of rotation result in starting and stopping problems and in dynamic balance problem when the rotor spins at high speeds.

Without the end surfaces of the Shiozawa et al. rotor, the desirable lower inertia and weight would be offset by an increase in undesirable windage drag due to centrifugal pump action as a result of air at ambient pressure near the shaft being accelerated radially toward a high velocity, high pressure region near the outer optics. Flow across a pressure differential constitutes work, and this work, at any particular speed, reflects to a torque load on the motor. Referring again to FIG. 4, curve "B" represents the motor current required to drive a rotor without end surfaces. While his configuration has an advantage of low inertia and ease of dynamic balance, it is incapable of high speed within the torque limits of reasonable sized motors due to excessive windage drag.

Figure 5:
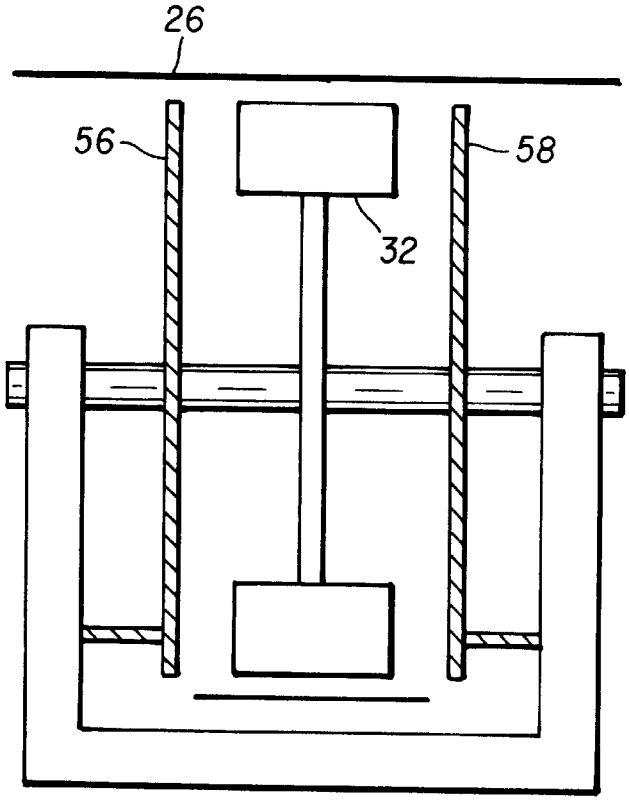
FIG. 5 is a schematic illustration of the structure of FIG. 3 for the purpose of explaining the effect of the present invention.

According to the present invention, a pair of static fixed disks 56 and 58 are mounted on opposed sides of rotor 32, as shown in FIG. 3. FIG. 5 is a schematic illustration of the structure of FIG. 3 for the purpose of explaining the effect of fixed disks 56 and 58. In FIG. 5, elements have been labeled with the corresponding reference numerals used in FIG. 3, but it will be understood that FIG. 5 is merely schematic, and that the elements are not shown in their actual form.

Disks 56 and 58, as mentioned above, are fixed, and do not rotate with rotor 32. Briefly, by adding fixed disks to block air flow, there is no contribution from the disks to rotor inertia. Second, a stationary windbreak greatly simplifies the task of routing motor and data wiring to the stator electronics from the rotor.

Figure 6:
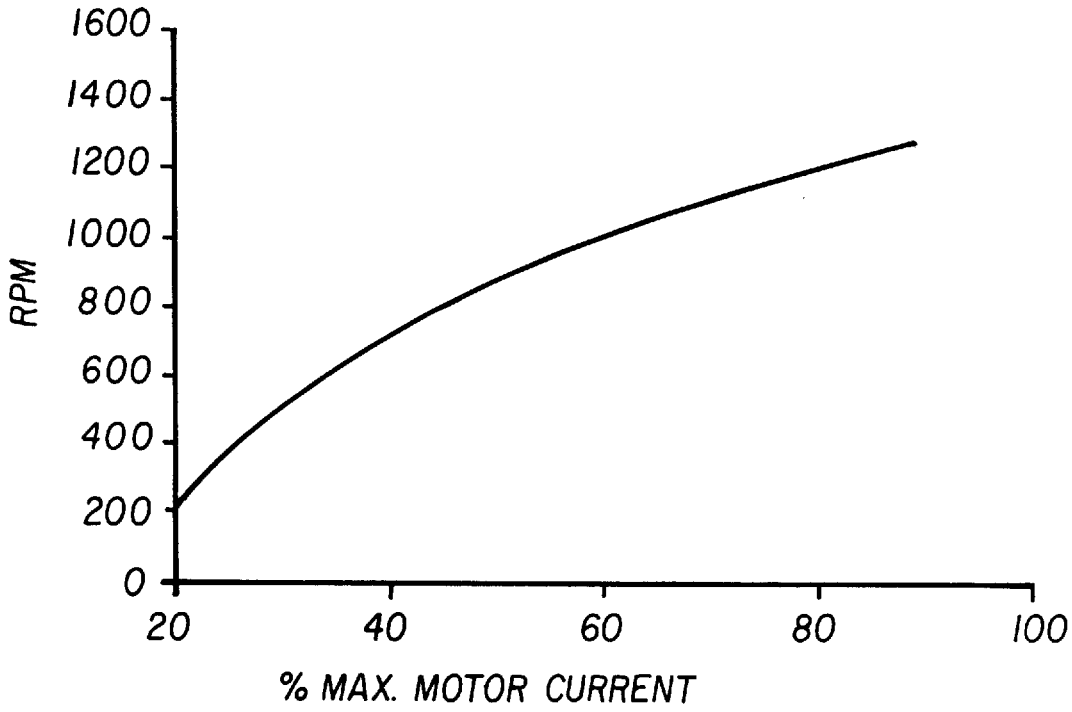
FIG. 6 is a graph of rotor speed versus the motor current required to drive a rotor according to the present invention.

FIG. 6 shows performance with a fixed disk on either side of the rotor. The fixed disks provided windage performance very nearly that of the rotor with attached ends, and the measured inertia of the system with fixed disks was found to be approximately 30% of the rotor with attached ends for the 10.5 inch diameter rotors tested. Larger diameter rotors would provide even greater inertia advantages.

Note from FIG. 6 that, at 90% of the maximum motor current, about 1,300 RPM was attained during this experiment. In similar tests conducted without fixed disks 56 and 58 in place, only 700 RPM could be attained at the same 90% of the maximum motor current.

The invention has been described in detail with particular reference to preferred embodiments thereof, but it will be understood that variations and modifications can be effected within the spirit and scope of the invention.

What is claimed is:

1. An imaging apparatus having a support shoe with an at-least-partially cylindrical inner surface for receiving a recording media, a rotor which is simultaneously rotatable about and linearly translated along a fixed axis, a write head assembly carried by the rotor to write on recording media received on the inner surface of the support shoe; said imaging apparatus further comprising a pair of disks having arcuate outer peripheries, said disks being supported within the support shoe for movement with the rotor along the fixed axis on opposed axial sides of the rotor.

2. An imaging apparatus as set forth in claim 1 wherein one of the disks leads the translation of the rotor along the fixed axis as the rotor moves in either axial direction during a write operation.

3. An imaging apparatus as set forth in claim 1 wherein the disks are rotationally fixed relative to the support shoe.

4. An imaging apparatus as set forth in claim 1 wherein the disks have circular outer peripheries.

* * * * *

UNITED STATES PATENT AND TRADEMARK OFFICE

CERTIFICATE OF CORRECTION

PATENT NO. : 5,825,406
DATED : October 20, 1998
INVENTOR(S) : David M. Orlicki, et al.

It is certified that error appears in the above-identified patent and that said Letters Patent is hereby corrected as shown below:

On the title page, insert the following:

--Related U.S. Application Data
[60] Provisional application No. 60/005,662, Oct. 18, 1995--.

Column 1, line 4 insert the following:

-- CROSS REFERENCE TO RELATED APPLICATION
Reference is made to and priority claimed from U.S. Provisional application Ser. No. US60/005,662, filed Oct. 18, 1995, entitled ROTATING WICK DEVICE--.

Signed and Sealed this

Fourth Day of May, 1999

*Attest:*

Q. TODD DICKINSON

*Attesting Officer*

*Acting Commissioner of Patents and Trademarks*